US009408510B2

(12) United States Patent
Factora et al.

(10) Patent No.: US 9,408,510 B2
(45) Date of Patent: Aug. 9, 2016

(54) HOUSEHOLD VACUUM CLEANER ATTACHMENT

(71) Applicants: Francis Factora, North Canton, OH (US); Sheldon Reid, North Canton, OH (US)

(72) Inventors: Francis Factora, North Canton, OH (US); Sheldon Reid, North Canton, OH (US)

( * ) Notice: Subject to any disclaimer, the term of this patent is extended or adjusted under 35 U.S.C. 154(b) by 200 days.

(21) Appl. No.: 13/902,058

(22) Filed: May 24, 2013

(65) Prior Publication Data

US 2014/0047660 A1 Feb. 20, 2014

(51) Int. Cl.

| | |
|---|---|
| ***A47L 9/00*** | (2006.01) |
| ***A47L 7/00*** | (2006.01) |
| ***A47L 9/24*** | (2006.01) |

(52) U.S. Cl.

CPC ..... *A47L 9/00* (2013.01); *A47L 7/0085* (2013.01); *A47L 9/248* (2013.01)

(58) Field of Classification Search

CPC ..... A47L 5/28; A47L 9/248; A47L 9/009; A47L 9/02; A47L 9/242; A47L 7/04

USPC ..... 15/246.2–246.4, 414, 415.1, 247, 15/257.1; D32/25, 32, 18, 33

See application file for complete search history.

(56) References Cited

U.S. PATENT DOCUMENTS

| | | | | |
|---|---|---|---|---|
| D325,656 | S * | 4/1992 | Davis | D32/21 |
| 5,375,928 | A * | 12/1994 | Yarng et al. | 383/24 |
| 5,904,196 | A * | 5/1999 | Wickers | 150/165 |
| D428,964 | S * | 8/2000 | King | D23/213 |
| 7,347,166 | B2 * | 3/2008 | Roman-Barcelo | A01K 13/002 119/677 |
| 2002/0170140 | A1 * | 11/2002 | Diaz et al. | 15/415.1 |
| 2003/0019063 | A1 * | 1/2003 | Abraham | 15/167.1 |
| 2003/0183242 | A1 * | 10/2003 | Kemp et al. | 132/311 |
| 2005/0120511 | A1 * | 6/2005 | Pedersen | 15/402 |

* cited by examiner

*Primary Examiner* — Dung Van Nguyen

(57) ABSTRACT

Embodiments may include an attachment for a vacuum cleaner calculated and adapted to engage the interest of a child. Thus, and embodiment may include a main body having an entertaining three dimensional adaptation for entertaining a child. It may also include an outlet end of the main body adapted to engage the suction end of a household vacuum cleaner hose, and an inlet end of the main body adapted to receive dirt and/or debris contained in an airstream, wherein the inlet end is in fluid communication with the outlet end.

18 Claims, 10 Drawing Sheets

HOUSEHOLD VACUUM CLEANER ATTACHMENT

I. BACKGROUND OF THE INVENTION

A. Field of Invention

Some embodiments may generally relate to the field of entertaining and/or teaching household hygiene habits to children.

B. Description of the Related Art

It is well known that teaching children to clean up after themselves can be challenging. It is almost universally true that people tend to prefer leisure and play time as opposed to work. This is especially true of children, and so it is especially helpful to couch work in terms of play. What is needed is a device which entices children to engage in household cleaning activities, by converting work into play. Some embodiments of the present invention may provide one or more benefits or advantages over the prior art.

II. SUMMARY OF THE INVENTION

Some embodiments may relate to an attachment for a vacuum cleaner, comprising: a main body having an entertaining three dimensional adaptation for entertaining a child; an outlet end of the main body adapted to engage the suction end of a household vacuum cleaner hose; and an inlet end of the main body adapted to receive dirt and/or debris contained in an airstream, wherein the inlet end is in fluid communication with the outlet end.

Some embodiments may further comprise a screen adapted to catch relatively large objects in an intake airstream at the inlet end of the main body.

According to some embodiments the screen has a mesh size from about 1 mm to about 25 mm.

Some embodiments may further comprise a trap disposed downstream from the inlet end of the main body and upstream from the outlet end of the main body, wherein the trap is adapted to catch relatively heavy objects in an inlet airstream before reaching an inline vacuum cleaner.

Some embodiments may further comprise a separable trap member adapted to be interposed between the outlet end of the main body and the suction end of a household vacuum cleaner hose, wherein the trap is adapted to catch relatively heavy objects in an inlet airstream before reaching an inline vacuum cleaner.

According to some embodiments the entertaining three dimensional adaptation is selected from one or more of an airplane, a sword, a battle tank, a rocket, a hammer, a rifle, a bayonet, a flamethrower, a rocket launcher, a shark, a whale, a snake, an eel, a magic wand, a flower, a baby doll, a baseball bat, a cricket bat, a rolling pin, or a cartoon and/or movie character.

According to some embodiments the trap comprises bomb bay doors on the ventral side of an airplane entertaining adaptation attachment, a detachable magazine box on a rifle entertaining adaptation attachment, or a fuel tank of a flamethrower entertaining adaptation attachment.

Some embodiment may relate to an attachment for a vacuum cleaner, comprising: a main body having an entertaining three dimensional adaptation for entertaining a child, wherein the entertaining three dimensional adaptation is selected from one or more of an airplane, a sword, a battle tank, a rocket, a hammer, a rifle, a bayonet, a flamethrower, a rocket launcher, a shark, a whale, a snake, an eel, a magic wand, a flower, a baby doll, a baseball bat, a cricket bat, a rolling pin, or a cartoon and/or movie character; an outlet end of the main body adapted to engage the suction end of a household vacuum cleaner hose; and an inlet end of the main body adapted to receive dirt and/or debris contained in an airstream, wherein the inlet end is in fluid communication with the outlet end.

Some embodiments may further comprise a screen adapted to catch relatively large objects in an intake airstream at the inlet end of the main body.

According to some embodiments the screen has a mesh size from about 1 mm to about 25 mm.

Some embodiments may further comprise a trap disposed downstream from the inlet end of the main body and upstream from the outlet end of the main body, wherein the trap is adapted to catch relatively heavy objects in an inlet airstream before reaching an inline vacuum cleaner.

Some embodiments may further comprise a separable trap member adapted to be interposed between the outlet end of the main body and the suction end of a household vacuum cleaner hose, wherein the trap is adapted to catch relatively heavy objects in an inlet airstream before reaching an inline vacuum cleaner.

According to some embodiments the trap comprises bomb bay doors on the ventral side of an airplane entertaining adaptation attachment, a detachable magazine box on a rifle entertaining adaptation attachment, or a fuel tank of a flamethrower entertaining adaptation attachment.

Some embodiments may relate to an attachment for a vacuum cleaner, comprising: a main body having an entertaining three dimensional adaptation for entertaining a child, wherein the entertaining three dimensional adaptation is selected from one or more of an airplane, a sword, a battle tank, a rocket, a hammer, a rifle, a bayonet, a flamethrower, a rocket launcher, a shark, a whale, a snake, an eel, a magic wand, a flower, a baby doll, a baseball bat, a cricket bat, a rolling pin, or a cartoon and/or movie character; an outlet end of the main body adapted to engage the suction end of a household vacuum cleaner hose; an inlet end of the main body adapted to receive dirt and/or debris contained in an airstream, wherein the inlet end is in fluid communication with the outlet end; a screen adapted to catch relatively large objects in an intake airstream at the inlet end of the main body; and a trap member disposed in fluid communication with an airstream path of the main body, wherein the trap is adapted to catch relatively heavy objects in an inlet airstream before reaching an inline vacuum cleaner.

Other benefits and advantages will become apparent to those skilled in the art to which it pertains upon reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION OF THE INVENTION

Figure 1:
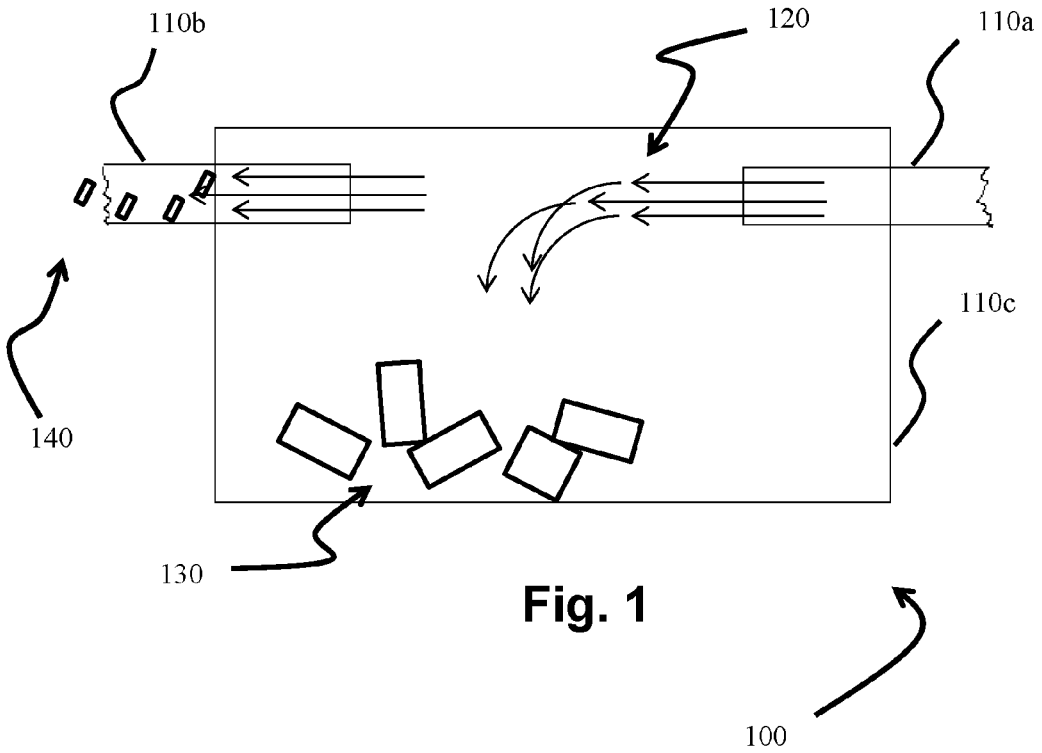
FIG. 1 is a schematic drawing of a trap system of an embodiment.

Some embodiments may comprise an attachment for a household vacuum cleaner which incorporates entertaining three dimensional designs adapted to engage the interest of a child and/or entertain a child through play. For instance, an embodiment may include a main body which may be adapted to engage the suction end of a household vacuum cleaner hose, and may further incorporate an entertaining design calculated and/or adapted to engage the interest of a child. A main body may include an inlet and an outlet, wherein the inlet and outlet are in fluid communication with each other and define an airflow path. The outlet of the main body may be adapted to engage a suction port of a household vacuum cleaner in a reversible retained relation. Thus, some embodiments may be attached and detached repeatedly, as the need arises.

Entertaining three dimensional designs calculated and/or adapted to engage the interest of a child can include, without limitation, one or more of an airplane, a sword, a battle tank, a rocket, a hammer, a rifle, a bayonet, a flamethrower, a rocket launcher, a shark, a whale, a snake, an eel, a magic wand, a flower, a baby doll, a baseball bat, a cricket bat, a rolling pin, or a cartoon and/or movie character. In general an entertaining design can be selected according to the gender and age range of the children defining a target audience. For instance, boys are more likely to be drawn toward sports and military themed embodiments, while girls are more likely to be drawn to doll and flower themed embodiments. However, embodiments may also include popular cartoon and/or movie characters or themes. For instance, a Disney® character theme such as Lady and the Tramp, a Marvel Comics® theme incorporating imagery from X-Men®, Barbie® themes, Sponge Bob Square Pants® themes, or other proprietary themes from popular culture.

Embodiments may optionally include means for removing some larger and/or heavier objects from a vacuum airstream. This may be a desirable feature because children may be more inclined than adults to entrain items in a vacuum airstream that should not be vacuumed. Such objects may include, without limitation, relatively large and/or heavy objects which may clog or damage the vacuum cleaner, or items which are not to be disposed of such as toys or valuables that happen to be within reach. One skilled in the art will appreciate that an embodiment can be constructed so that objects having a predetermined mass will tend to fall out of an airstream. A suitable means for removing items from the airstream may tend to remove dirt and small particles while trapping larger items such as coins, jewelry, toys, etc.

Examples of suitable means for removing entrained items from an intake airstream can comprise a screen member and/or a gravity-driven trap. For instance, a screen having a suitable predetermined mesh size may be placed at an inlet of the main body so that entrained objects can be readily removed or will simply fall away from the screen when the vacuum is powered off. Additionally or alternatively, a screen may be placed at other points along the airstream flow path of the embodiment as appropriate.

Figure 2:
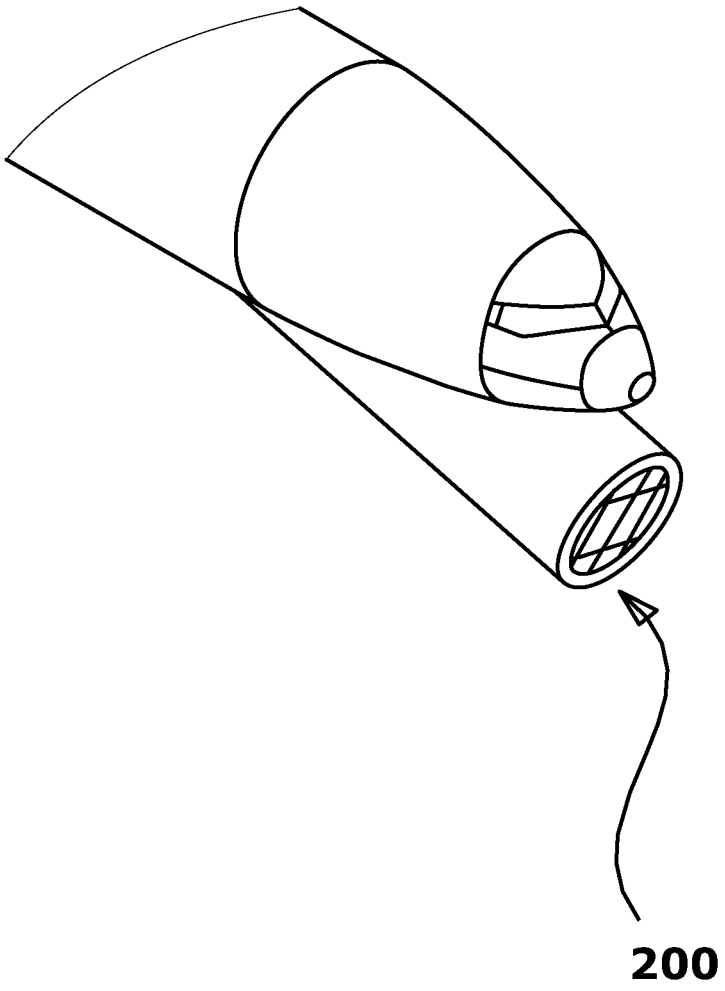
FIG. 2 is a perspective view drawing of an inline screen at an inlet of an embodiment.

Referring now to the drawings wherein the showings are for purposes of illustrating embodiments of the invention only and not for purposes of limiting the same, FIG. 1 is a schematic drawing of a gravity-driven trap system 100 according to an embodiment. As shown in FIG. 1, a trap comprises a catch box 110*c* having an air inlet port 110*a* and an air outlet port 110*b*. The trap can be disposed inline in an airstream flow path of an embodiment. Thus, an airstream 120 along with entrained debris 130 and 140 enters the trap 100 at the inlet port 110*a*, the heavier debris 130 fall out of the airstream 120 and are collected at the bottom of the catch box 110*c*, and the remaining smaller debris 140 remain entrained in the airstream 120 and exit through the outlet port 110*b*. FIG. 2 illustrates a screen 200 placed inline in an embodiment's airstream at a foremost end of the inlet.

Figure 3:
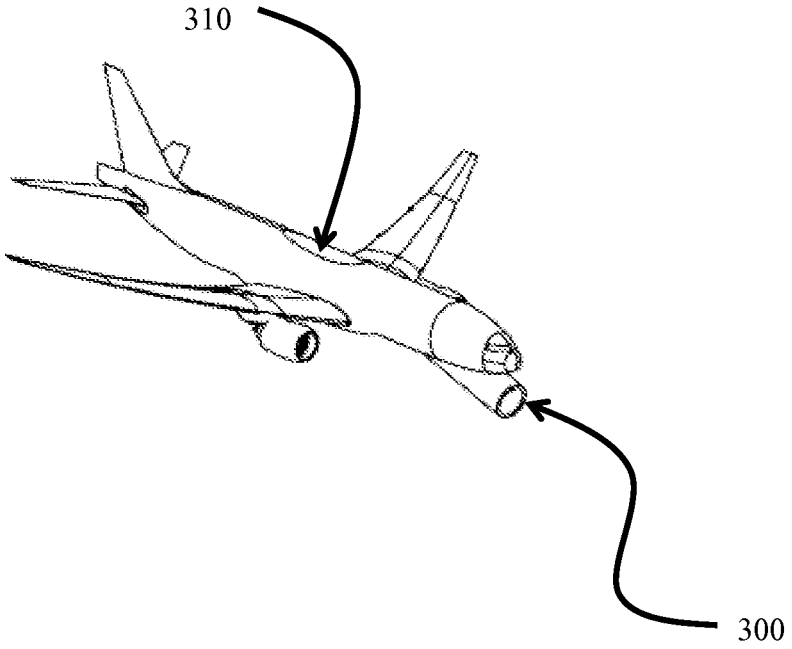
FIG. 3 is a drawing of an embodiment comprising an entertaining three dimensional adaptation of an airplane.
Figure 4:
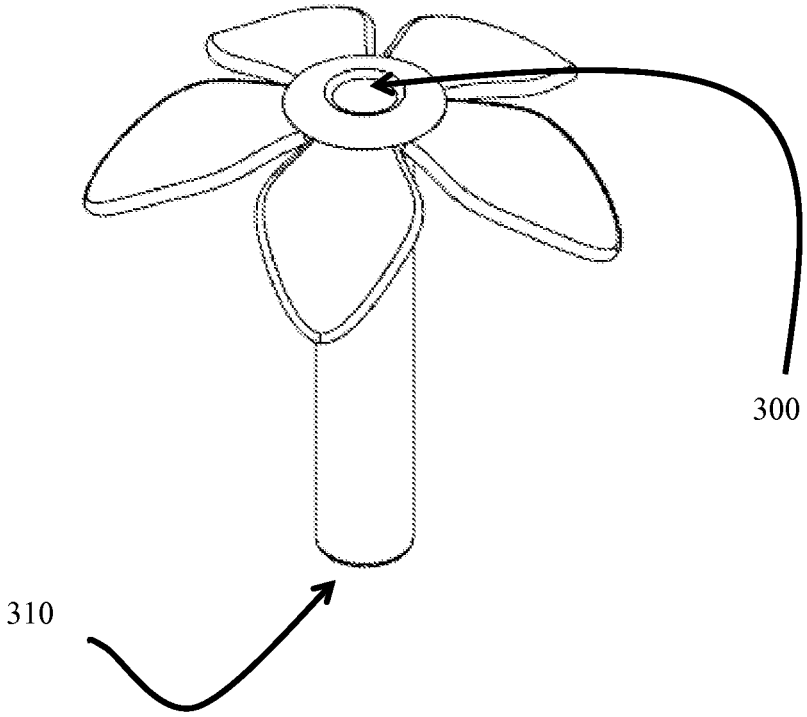
FIG. 4 is a drawing of an embodiment comprising an entertaining three dimensional adaptation of a flower.
Figure 5:
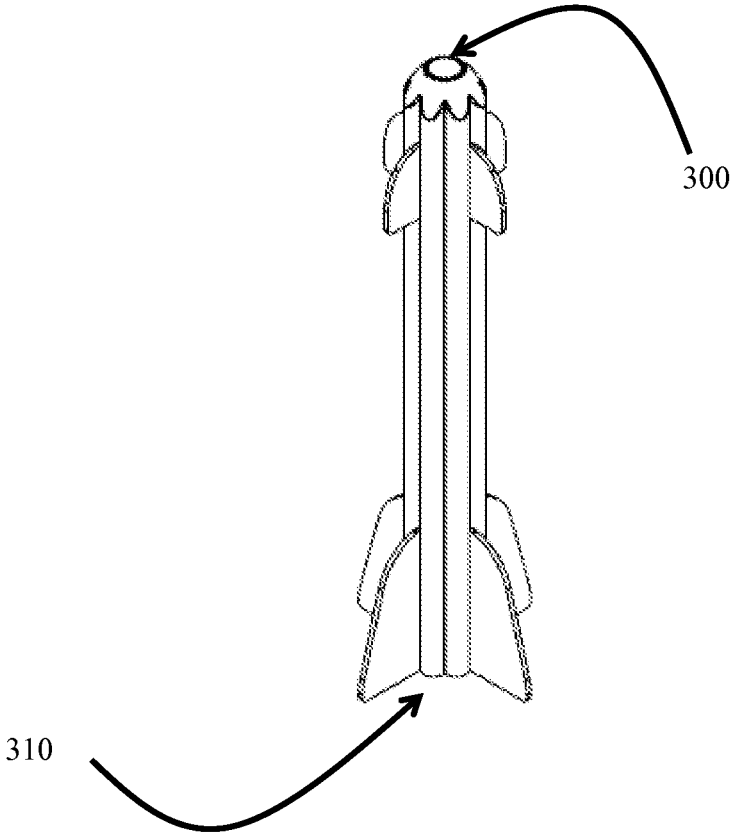
FIG. 5 is a drawing of an embodiment comprising an entertaining three dimensional adaptation of a rocket.
Figure 6:
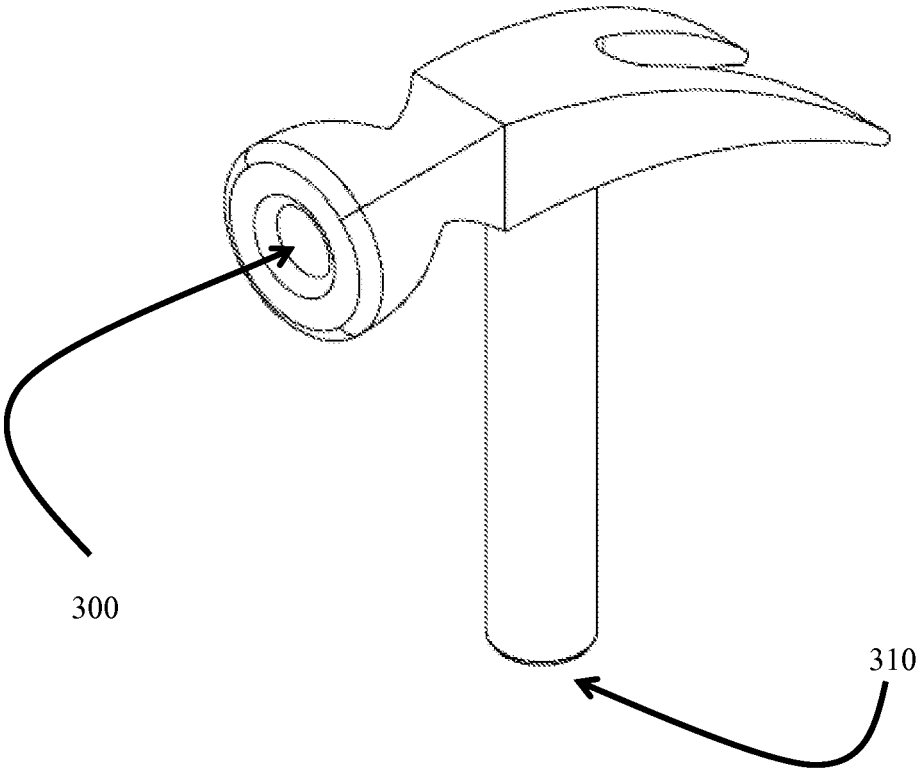
FIG. 6 is a drawing of an embodiment comprising an entertaining three dimensional adaptation of hammer.
Figure 7:
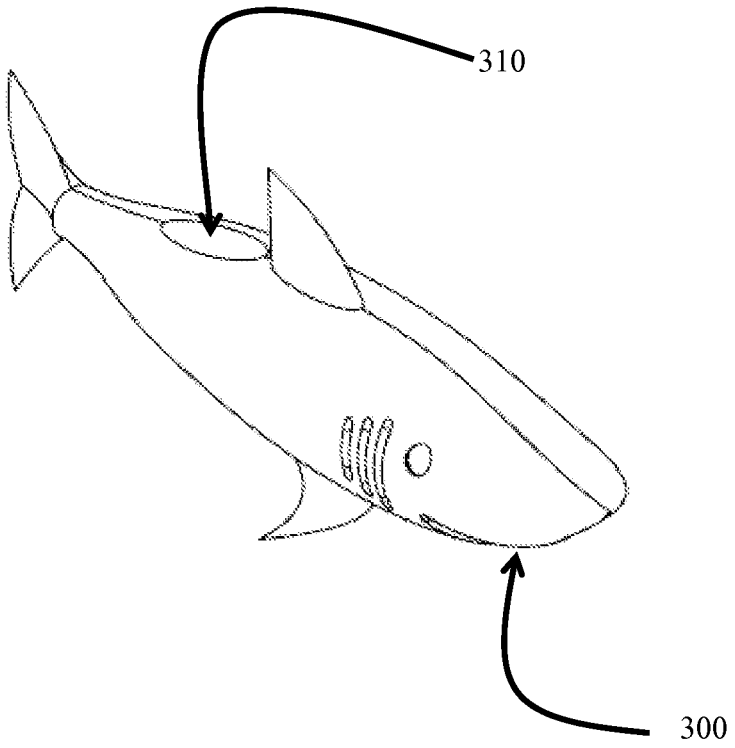
FIG. 7 is a drawing of an embodiment comprising an entertaining three dimensional adaptation of a shark.
Figure 8:
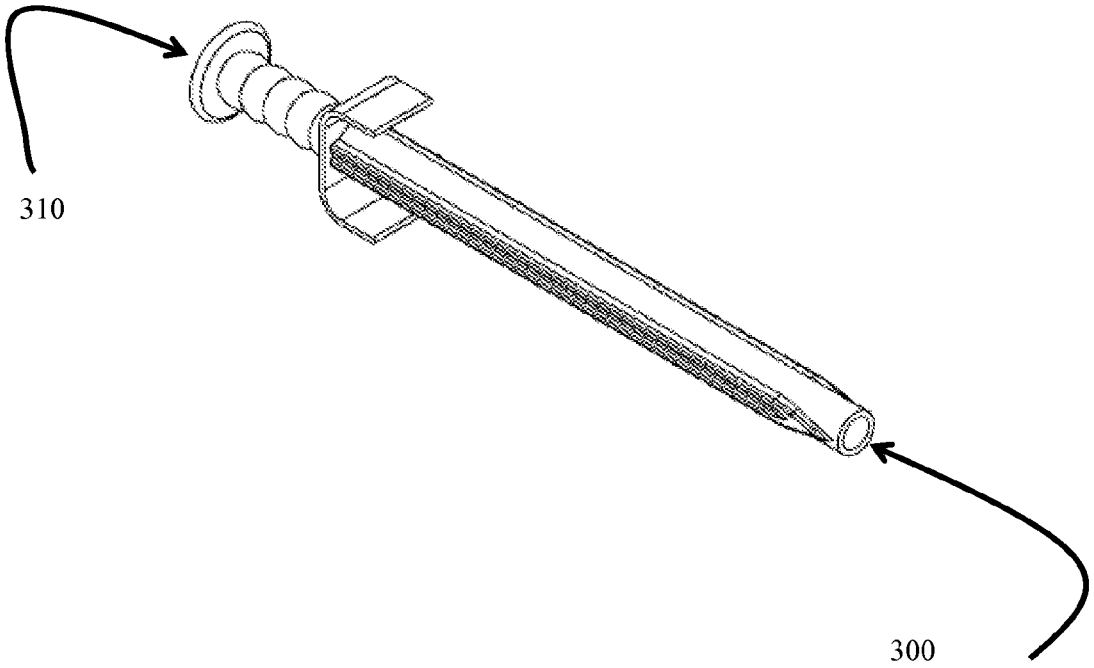
FIG. 8 is a drawing of an embodiment comprising an entertaining three dimensional adaptation of a sword.
Figure 9:
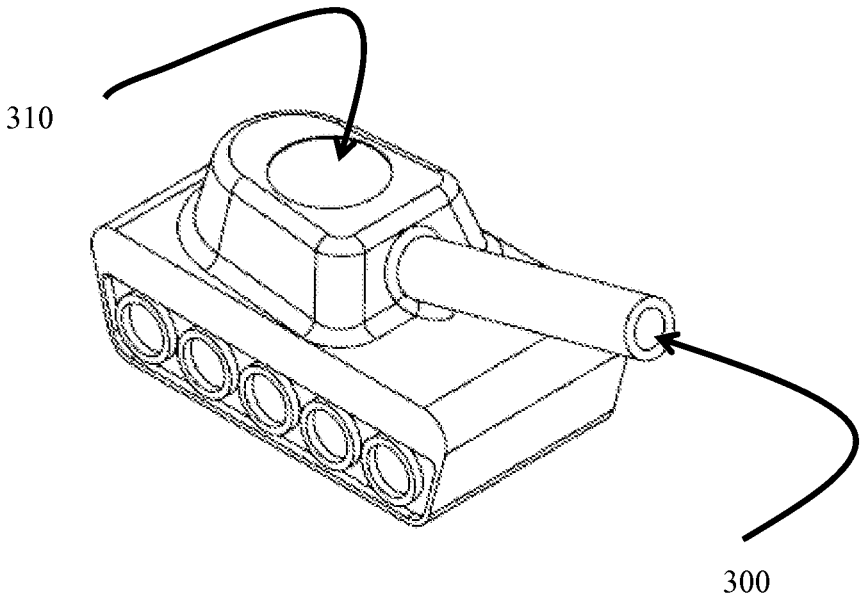
FIG. 9 is a drawing of an embodiment comprising an entertaining three dimensional adaptation of a battle tank.
Figure 10:
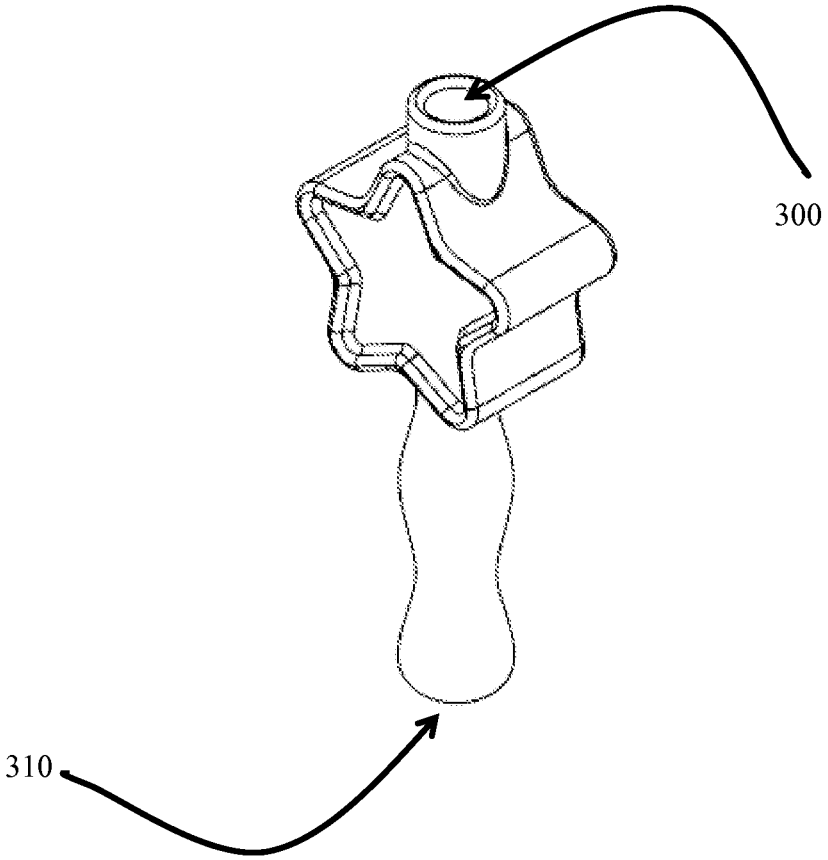
FIG. 10 is a drawing of an embodiment comprising an entertaining three dimensional adaptation of a magic wand.

The remaining FIGS. 3 through 10 are drawings of illustrative entertaining three dimensional designs. Particularly, FIG. 3 is a drawing of an airplane design where the inlet port 300 is just under the nose of the plane, and the outlet 310 is disposed in a rear of the plane. FIG. 4 is a drawing of a flower design where the inlet port 300 is disposed in the center of the flower petals and the outlet port is at the base of the stem 310. In both FIGS. 3 and 4 the airstream flow path is shown substantially straight; however, one skilled in the art will appreciate that a flow path may be curved or otherwise contoured provided that contours are sufficiently subtle to impede clogging. FIG. 5 comprises a rocket embodiment with an inlet port 300 at the nose and an outlet port 310 at the tail. FIG. 6 comprises a hammer embodiment where the inlet port 300 is at the striking surface of the hammer, and the outlet port 310 is at the base of the handle. FIG. 7 comprises a shark embodiment where the inlet port 300 is at the mouth end of the shark and the outlet port 310 is behind the dorsal fin. FIG. 8 comprises a sword embodiment where the inlet port 300 is at the tip of the sword and the outlet port 310 is at the hilt. FIG. 9 comprises a battle tank embodiment where the inlet port 300 is at an end of the cannon and the outlet port 310 is in the turret. Finally, FIG. 10 comprises a magic wand embodiment where the inlet port 300 is at the tip of the wand and the outlet port 310 is at the base of its handle.

It will be apparent to those skilled in the art that the above methods and apparatuses may be changed or modified without departing from the general scope of the invention. The invention is intended to include all such modifications and alterations insofar as they come within the scope of the appended claims or the equivalents thereof.

We claim:

1. An attachment for a vacuum cleaner, comprising:

a main body having an entertaining three dimensional adaptation for entertaining a child;

an outlet end of the main body adapted to engage the suction end of a household vacuum cleaner hose;

an inlet end of the main body adapted to receive dirt and/or debris contained in an airstream, wherein the inlet end is in fluid communication with the outlet end;

a screen having a predetermined mesh size disposed at the foremost end of the inlet of the main body; and a gravity-driven trap, disposed inline in the airstream of the main body, and having an inlet port in fluid communication with a catch box, and an outlet port in fluid communication with, and downstream from, the catch box.

2. The attachment of claim 1, further comprising a screen adapted to catch objects larger than a predetermined mesh size in an intake airstream at the inlet end of the main body.

3. The attachment of claim 2, wherein the screen has a mesh size from about 1 mm to about 25 mm.

4. The attachment of claim 1, further comprising a trap disposed downstream from the inlet end of the main body and upstream from the outlet end of the main body, wherein the trap is adapted to catch objects above a predetermined mass in an inlet airstream before reaching an inline vacuum cleaner.

5. The attachment of claim 4, wherein the trap comprises bomb bay doors on a ventral side of an airplane entertaining adaptation attachment, a detachable magazine box on a rifle entertaining adaptation attachment, or a fuel tank of a flamethrower entertaining adaptation attachment.

6. The attachment of claim 1, further comprising a separable trap member adapted to be interposed between the outlet end of the main body and the suction end of a household vacuum cleaner hose, wherein the trap is adapted to catch relatively heavy objects in an inlet airstream before reaching an inline vacuum cleaner.

7. The attachment of claim 1, wherein the entertaining three dimensional adaptation is selected from one or more of an airplane, a sword, a battle tank, a rocket, a hammer, a rifle, a bayonet, a flamethrower, a rocket launcher, a shark, a whale, a snake, an eel, a magic wand, a flower, a baby doll, a baseball bat, a cricket bat, a rolling pin, or a cartoon and/or movie character.

8. An attachment for a vacuum cleaner, comprising:

a main body having an entertaining three dimensional adaptation for entertaining a child, wherein the entertaining three dimensional adaptation is selected from one or more of an airplane, a sword, a battle tank, a rocket, a hammer, a rifle, a bayonet, a flamethrower, a rocket launcher, a shark, a whale, a snake, an eel, a magic wand, a flower, a baby doll, a baseball bat, a cricket bat, a rolling pin, or a cartoon and/or movie character;

an outlet end of the main body adapted to engage the suction end of a household vacuum cleaner hose;

an inlet end of the main body adapted to receive dirt and/or debris contained in an airstream, wherein the inlet end is in fluid communication with the outlet end;

a screen having a predetermined mesh size disposed at the foremost end of the inlet of the main body; and a gravity-driven trap, disposed inline in the airstream of the main body, and having an inlet port in fluid communication with a catch box, and an outlet port in fluid communication with, and downstream from, the catch box.

9. The attachment of claim 8, further comprising a screen adapted to catch objects larger than a predetermined mesh size in an intake airstream at the inlet end of the main body.

10. The attachment of claim 9, wherein the screen has a mesh size from about 1 mm to about 25 mm.

11. The attachment of claim 8, further comprising a trap disposed downstream from the inlet end of the main body and upstream from the outlet end of the main body, wherein the trap is adapted to catch objects above a predetermined mass in an inlet airstream before reaching an inline vacuum cleaner.

12. The attachment of claim 8, further comprising a separable trap member adapted to be interposed between the outlet end of the main body and the suction end of a household vacuum cleaner hose, wherein the trap is adapted to catch relatively heavy objects in an inlet airstream before reaching an inline vacuum cleaner.

13. The attachment of claim 11, wherein the trap comprises bomb bay doors on a ventral side of an airplane entertaining adaptation attachment, a detachable magazine box on a rifle entertaining adaptation attachment, or a fuel tank of a flamethrower entertaining adaptation attachment.

14. An attachment for a vacuum cleaner, comprising:

a main body having an entertaining three dimensional adaptation for entertaining a child, wherein the entertaining three dimensional adaptation is selected from one or more of an airplane, a sword, a battle tank, a rocket, a hammer, a rifle, a bayonet, a flamethrower, a rocket launcher, a shark, a whale, a snake, an eel, a magic wand, a flower, a baby doll, a baseball bat, a cricket bat, a rolling pin, or a cartoon and/or movie character;

an outlet end of the main body adapted to engage the suction end of a household vacuum cleaner hose;

an inlet end of the main body adapted to receive dirt and/or debris contained in an airstream, wherein the inlet end is in fluid communication with the outlet end;

a screen adapted to catch objects larger than a predetermined mesh size in an intake airstream at the foremost end of the inlet end of the main body;

a trap member disposed in fluid communication with an airstream path of the main body, wherein the trap is adapted to catch objects above a predetermined mass in an inlet airstream before reaching an inline vacuum cleaner; and wherein the trap member is a gravity-driven trap, disposed inline in the airstream of the main body, and having an inlet port in fluid communication with a catch box, and an outlet port in fluid communication with, and downstream from, the catch box.

15. The attachment of claim 14, wherein the screen has a mesh size from about 1 mm to about 25 mm.

16. The attachment of claim 14, wherein the trap is disposed downstream from the inlet end of the main body and upstream from the outlet end of the main body.

17. The attachment of claim 16, wherein the trap comprises bomb bay doors on a ventral side of an airplane entertaining adaptation attachment, a detachable magazine box on a rifle entertaining adaptation attachment, or a fuel tank of a flamethrower entertaining adaptation attachment.

18. The attachment of claim 14, wherein the trap member comprises a separable trap member adapted to be interposed between the outlet end of the main body and the suction end of a household vacuum cleaner hose.

* * * * *